US009005858B2

(12) United States Patent
Yoon et al.

(10) Patent No.: US 9,005,858 B2
(45) Date of Patent: Apr. 14, 2015

(54) TONER TO DEVELOP ELECTROSTATIC LATENT IMAGES

(71) Applicant: Samsung Electronics Co., Ltd., Suwon-si, Gyeonggi-do (KR)

(72) Inventors: Se-young Yoon, Hwaseong-si (KR); Sung-jin Park, Suwon-si (KR); Hong-chul Shin, Suwon-si (KR); Seung-sik Woo, Hwaseong-si (KR); Hae-ree Joo, Anyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/795,196

(22) Filed: Mar. 12, 2013

(65) Prior Publication Data

US 2013/0236824 A1 Sep. 12, 2013

(30) Foreign Application Priority Data

Mar. 12, 2012 (KR) ..... 10-2012-0025218

(51) Int. Cl.

*G03G 9/083* (2006.01)
*G03G 9/08* (2006.01)
*G03G 9/097* (2006.01)

(52) U.S. Cl.

CPC ..... *G03G 9/08* (2013.01); *G03G 9/0804* (2013.01); *G03G 9/0821* (2013.01); *G03G 9/0823* (2013.01); *G03G 9/0825* (2013.01); *G03G 9/09708* (2013.01); *G03G 9/09716* (2013.01); *G03G 9/09725* (2013.01)

(58) Field of Classification Search

CPC ..... G03G 9/09708; G03G 9/09725
USPC ..... 430/108.24, 108.6, 108.7, 106.3
See application file for complete search history.

(56) References Cited

U.S. PATENT DOCUMENTS

| | | | | |
|---|---|---|---|---|
| 5,705,306 | A * | 1/1998 | Kitani et al. | 430/108.22 |
| 2007/0009294 | A1 | 1/2007 | Kuramashi | |
| 2008/0166648 | A1* | 7/2008 | Veregin et al. | 430/108.6 |
| 2008/0227015 | A1* | 9/2008 | Nagatomo et al. | 430/109.4 |
| 2009/0197192 | A1* | 8/2009 | Hiroko et al. | 430/106.2 |
| 2010/0196814 | A1* | 8/2010 | Joo et al. | 430/108.4 |

FOREIGN PATENT DOCUMENTS

| | | |
|---|---|---|
| JP | 2002-006553 | 1/2002 |
| JP | 2003-295503 | 10/2003 |
| JP | 2007-010715 | 1/2007 |
| JP | 2011-102892 | 5/2011 |

* cited by examiner

*Primary Examiner* — Peter Vajda
(74) *Attorney, Agent, or Firm* — Staas & Halsey LLP

(57) ABSTRACT

A toner to develop electrostatic latent images, which has surface characteristics that may simultaneously improve charge uniformity, charge stability, transferability, and cleaning ability. The toner to develop electrostatic latent images may include core particles comprising a binder resin, a colorant, and a releasing agent; and an external additive including silica particles and titanium dioxide particles, wherein the external additive is attached to external surfaces of the core particles, wherein an iron intensity [Fe], a silicon intensity [Si], and a titanium intensity [Ti] that are measured by X-ray fluorescence (XRF) satisfy both conditions, $0.004 \leq [Si]/[Fe] \leq 0.009$ and $0.8 \leq [Ti]/[Fe] \leq 2$.

7 Claims, No Drawings

TONER TO DEVELOP ELECTROSTATIC LATENT IMAGES

CROSS-REFERENCE TO RELATED APPLICATIONS

This application claims the benefit of Korean Patent Application No. 10-2012-0025218, filed on Mar. 12, 2012, in the Korean Intellectual Property Office, the disclosure of which is incorporated herein in its entirety by reference.

BACKGROUND OF THE INVENTION

1. Field of the Invention

The present general inventive concept relates to an electrophotographic toner, and more particularly to a toner to develop electrostatic latent images.

2. Description of the Related Art

A high level of performance is demanded for printing devices such as printers and copiers. A printer that performs at a high level provides full-color and has a printing speed that is very fast. Such printers are capable of producing high quality images and are compact, inexpensive, and environmentally friendly. In order to meet such a trend, technology for controlling a shape and surface of toner particles while obtaining physical properties of electrophotographic toner has become more important than ever before.

As the printing speed of printers increases, the number of times a shearing force is exerted on toner increases. Thus, demand for high durability of toner is on the rise. To implement a compact and environmentally friendly printer, the amount of "untransferred toner" has to be reduced. In this regard, improvement of charge uniformity and transferability of toner is demanded. In order to obtain high quality print images, improvements in charge stability, transferability, and cleaning ability of toner are required.

Improvements in surface characteristics of toner particles are required to achieve excellent charge uniformity, charge stability, transferability, and cleaning ability with respect to the toner particles. One of the most important factors affecting the surface characteristics of toner particles may be an external additive that is added to the surface of toner particles. One of the main functions of the external additive is to help toner powder to maintain fluidity by preventing the toner particles from attaching to each other. Obviously, an external additive may also affect charge uniformity, charge stability, transferability, and cleaning ability. A silica powder or a titanium oxide powder is mainly used as an external additive.

However, a conventional external additive is known to be unfavorable in terms of obtaining charge uniformity. For example, fumed silica, which is the most commonly used external additive, has a very strong negative polarity. Accordingly, an excessive charge-up phenomenon may frequently occur in a toner that has fumed silica externally added thereto.

A method of additionally externally adding titanium oxide particles to prevent excessive frictional charging due to the excessive charge-up phenomenon caused by the fumed silica has been tried. However, since titanium oxide has low electric resistance and good charge exchangeability, relatively reverse or weak charging toner may be easily produced. Thus, when toner is externally added with silica, charge uniformity of the toner may be reduced.

Silica particles may be porous. Also, silica particles may have hydrophilic surfaces. If silica particles are highly porous and the surfaces thereof are highly hydrophilic, toner that is externally added with the silica particles in a high-temperature and high-humidity environment may not be well charged due to excessive absorption of moisture, which serves as an electrical conductor. On the other hand, toner that is externally added with the silica particles is generally excessively charged in a low-temperature and low-humidity environment. That is, charge stability of toner externally added with the silica particles, which varies depending on the environment, may be deteriorated.

Silica particles or titan oxide particles that are surface-treated with a surface treating agent such as hydrophobic silicone oil or a hydrophobic silica coupling agent may be used as an external additive in order to solve environmental charge stability degradation due to moisture. However, if such external additive particles treated with the surface treating agent are used, cohesiveness between toner particles increases, and thus fluidity of the toner powder may be rapidly degraded.

In a method of manufacturing fumed silica particles, aggregation of the silica particles occurs frequently. The aggregation degrades dispersibility of the fumed silica powder. If an external additive powder with unfavorable dispersibility is used, fluidity, anti-caking ability, fusibility, and cleaning ability of toner obtained as a result may also be degraded.

Sol-gel silica may be used in order to avoid such aggregation of fumed silica. A sol-gel silica powder refers to a silica powder manufactured by using a sol-gel method. For example, the sol-gel silica powder may be obtained by removing a solvent from a sol-gel suspension that is produced by hydrolyzing and condensing alkoxy silane in an organic solvent in which water is present. The sol-gel silica powder manufactured by using the sol-gel method is formed of spherical silica particles with uniform particle size. Conventional sol-gel silica particles have almost a perfect sphere shape. However, if silica particles with a sphericity near 1 are used as an external additive, cleaning ability of toner may be degraded.

Thus, simultaneously improving charge uniformity, charge stability, transferability, and cleaning ability of toner is very difficult.

SUMMARY OF THE INVENTION

The present general inventive concept provides a toner to develop electrostatic latent images which includes surface characteristics that may simultaneously improve charge uniformity, charge stability, transferability, and cleaning ability.

Additional features and utilities of the present general inventive concept will be set forth in part in the description which follows and, in part, will be obvious from the description, or may be learned by practice of the general inventive concept.

Exemplary embodiments of the present general inventive concept provide a toner to develop electrostatic latent images, the toner including: core particles comprising a binder resin, a colorant, and a releasing agent; and an external additive comprising silica particles and titanium dioxide particles, wherein the external additive is attached to external surfaces of the core particles, wherein an iron intensity [Fe], a silicon intensity [Si], and a titanium intensity [Ti] that are measured by X-ray fluorescence (XRF) satisfy both conditions, $0.004 \leq [Si]/[Fe] \leq 0.009$ and $0.8 \leq [Ti]/[Fe] \leq 2$.

DETAILED DESCRIPTION OF THE PREFERRED EMBODIMENTS

The present general inventive concept will now be described more fully with reference to the accompanying drawings, in which exemplary embodiments of the present general inventive concept are shown.

A toner to develop electrostatic latent images according to an embodiment of the present general inventive concept includes toner particles. The toner particles may include core particles and an external additive that is attached to external surfaces of the core particles. The core particles may include a binder resin, a colorant, and a releasing agent. The external additive may include silica particles and titanium dioxide particles.

A content of iron [Fe], a content of silicon [Si], and a content of titanium [Ti] were measured by X-ray fluorescence (XRF) spectrometry. In the current embodiment of the present general inventive concept, XRF measurement was performed using an energy X-ray fluorescence spectrometer (EDX-720) manufactured by SHIMADZU Corporation. A tube voltage was 50 kV, and the amount of samples that were molded were 3 g±0.01 g. For each sample, a content of iron [Fe], a content of silicon [Si], and a content of titanium [Ti] were calculated using intensities (unit: cps/μA) from quantitative results obtained by the XRF measurement.

In order to simultaneously improve charge uniformity, charge stability, transferability, and cleaning ability of the toner, [Fe], [Si], and [Ti] of the toner have to simultaneously satisfy all the conditions listed below:

$$0.004 \leq [Si]/[Fe] \leq 0.009, \text{ and}$$

$$0.8 \leq [Ti]/[Fe] \leq 2.$$

If the [Si]/[Fe] ratio is less than 0.004, a developing/transferring property may be deteriorated and durability may be degenerated. If the [Si]/[Fe] ratio is greater than 0.009, contamination caused by cleaning deterioration of a charging member or latent image carrier may occur. If the [Ti]/[Fe] ratio is less than 0.8, an image may be contaminated due to charge-up. If the [Ti]/[Fe] ratio is greater than 2, a photoreceptor background may be contaminated. Thus, [Fe], [Si], and [Ti] of the toner have to simultaneously satisfy all the conditions listed above.

Meanwhile, the [Si]/[Ti] ratio is preferable to be in a range of about 0.002 to about 0.1. If the [Si]/[Ti] ratio is about 0.002 or greater, a degree of the OPC background contamination may be significantly reduced. If the [Si]/[Ti] ratio is about 0.1 or less, a degree of image contamination due to charge-up may be significantly reduced.

[Si] of toner is mainly derived from silica used as an external additive. [Ti] of toner is mainly derived from titanium dioxide used as an external additive. [Fe] of toner is mainly derived from an aggregating agent used in a process of manufacturing the core particles. Thus, the [Si]/[Fe] ratio, the [Ti]/[Fe] ratio, and the [Si]/[Ti] ratio may be appropriately selected by controlling added amounts of silica and titanium dioxide that are used as an external additive.

The silica particles may be, for example, fumed silica, sol-gel silica, or a mixture thereof.

If a primary particle size of the silica particles is too large, the externally added toner particles may be relatively difficult to pass through a developing blade. Accordingly, a selection phenomenon may occur. That is, as a life time of a toner cartridge increases, a particle size of the toner particles remaining in the toner cartridge gradually increases. As a result, a quantity of charge decreases, and thus a thickness of a toner layer on which an electrostatic latent image is developed increases. Also, if a primary particle size of the silica particles is too large, a probability of the silica particles to be separated from the core particles may relatively increase. The separated silica particles may contaminate the charging member or the latent image carrier. On the other hand, if a primary particle size of the silica particles is too small, the silica particles are apt to be embedded into the core particles due to shearing stress of a developing blade that is induced on a toner. If the silica particles are embedded into the core particles, the silica particles lose a function as an external additive, and thus adhesion between the toner particles and a surface of an OPC may be undesirably increased. Consequently, cleaning ability and transferability of the toner decrease. A volume average particle size of the silica particles may be in a range of, for example, about 10 nm to about 80 nm, about 30 nm to about 80 nm, or about 60 nm to about 80 nm.

A toner according to another embodiment of the present general inventive concept may include silica particles with a large diameter of a volume average particle size in a range of about 30 nm to about 100 nm and silica particles with a small diameter of a volume average particle size in a range of about 5 nm to about 20 nm. The silica particles with a small diameter provide a larger surface area than the silica particles with a large diameter and serve to further improve charge stability of toner particles. Also, the silica particles with a small diameter are attached to core particles while they are disposed between the silica particles with a large diameter. Thus, even when the shearing stress is induced to the toner from an external source, the shearing stress is not conveyed to the silica particles with a small diameter. That is, the shearing stress induced to the toner from an external source is directed to the silica particles with a large diameter. Accordingly, the silica particles with a small diameter are not embedded into the core particles, and thus the improved charge stability may be maintained. If a content of the silica particles with a small diameter as compared to the silica particles with a large diameter is too low, durability of the toner drops, and charge stability may be insignificantly improved. If a content of the silica particles with a small diameter as compared to the silica particles with a large diameter is too high, contamination may be caused by cleaning deterioration of a charging member or latent image carrier. A weight ratio of the silica particles with a large diameter to the silica particles with a small diameter may be, for example, from about 0.5:1.5 to about 1.5:0.5.

Titanium dioxide may be, for example, titanium dioxide having an anatase crystal structure, titanium dioxide having a rutile crystal structure, or a mixture thereof. Titanium dioxide having a rutile crystal structure is preferable to be used as an external additive of the toner. If only silica with a strong negative chargeability is externally added to a surface of the toner, a charge-up phenomenon may easily occur. Particularly, in a contact type development system, a quantity of the toner attached on a developing roller increases, and thus the thickness of the toner layer may be increased. In a non-contact type development system, if titanium oxide is not used, a quantity of charge is high, and thus image concentration is low as developing ability is decreased. Therefore, a charge deviation is reduced and charge-up is improved under high-temperature and high-humidity conditions or low-temperature and low-humidity conditions by adding titanium oxide to stabilize a rapid change in charge which is caused when only silica is externally added. However, if titanium oxide is overused, background contamination may occur. Thus, an appropriated ratio of silica with a strong negative chargeability and titanium oxide with a low negative chargeability is one of the most important factors that may affect an electrophotographic system such as durability and other image contamination as well as a quantity of charge. Titanium dioxide particles may have a volume average particle size in a range of, for example, about 10 nm to about 50 nm.

The silica particles and the titanium dioxide particles may be hydrophobically treated with, for example, silicone oils, silanes, siloxanes, or silazanes. A degree of hydrophobicity of each of the silica particles and the titanium dioxide particles may be in a range of about 10 to about 90. The degree of hydrophobicity refers to a value measured by using a methanol titration method known in the art. For example, the degree of hydrophobicity may be measured as follows. To a glass beaker with an internal diameter of 7 cm, a capacity of 200 ml or more, and containing 100 ml of ion exchange water is added 0.2 g of silica particles or titanium dioxide particles for measuring the degree of hydrophobicity, and is stirred with a magnetic stirrer. A tip part of a burette containing methanol is immersed in the suspension, into which 2 l of methanol is dripped while being stirred, the stirring is stopped after 30 seconds, and 1 minute after stopping the stirring the state of the suspension is observed. This operation is repeatedly performed. When the silica particles do not float on the water surface 1 minute after stopping the stirring, the total added amount of methanol is taken as Y (ml) and a value obtained by the following formula is calculated as the degree of hydrophobicity. The water temperature in the beaker is adjusted to about 20° C.±1° C. to perform the measurement. The degree of hydrophobicity=[Y/(100+Y)×100].

An added amount of the external additive used in the current embodiment of the present general inventive concept may preferably include an added amount of the silica particles with a large particle diameter of about 0.1 parts to about 2 parts by weight, an added amount of the silica particles with a small particle diameter of about 0.1 parts to about 2 parts by weight, and an added amount of titanium dioxide of about 0.1 parts to about 2 parts by weight based on 100 parts by weight of the core particles.

The core particles include a binder resin, a colorant, and a releasing agent.

The binder resin may be, for example, styrene resin, acrylic resin, vinyl resin, polyether polyol resin, phenol resin, silicon resin, polyester resin, epoxy resin, polyamide resin, polyurethane resin, polybutadiene resin, or a mixture thereof.

The styrene resin may be, for example, polystyrene; homopolymer of styrene substitution such as poly-p-chlorostyrene or polyvinyltoluene; styrene-based copolymer such as styrene-p-chlorostyrene copolymer, styrene-vinyltoluene copolymer, styrene-vinylnaphthalene copolymer, styrene-acrylic acid ester copolymer, styrene-methacrylic acid ester copolymer, styrene-α-chloromethacrylic acid methyl copolymer, styrene-acrylonitrile copolymer, styrene-vinylmethylether copolymer, styrene-vinylethylether copolymer, styrene-vinylmethylketone copolymer, styrene-butadiene copolymer, styrene-isoprene copolymer, or styrene-acrylonitrile-inden copolymer; or a mixture thereof.

The acrylic resin may be, for example, acrylic acid polymer, methacrylic acid polymer, methacrylic acid methylester polymer, α-chloromethacrylic acid methylester polymer, or a mixture thereof.

The vinyl resin may be, for example, vinyl chloride polymer, ethylene polymer, propylene polymer, acrylonitrile polymer, vinyl acetic acid polymer, or a mixture thereof.

A number average molecular weight of the binder resin may be, for example, in a range of about 700 to about 1,000,000, or about 10,000 to about 200,000.

The colorant may be, for example, black colorant, yellow colorant, magenta colorant, cyan colorant, or a combination thereof.

The black colorant may be, for example, carbon black, aniline black, or a mixture thereof.

The yellow colorant may be, for example, a condensed nitrogen compound, an isoindolinone compound, an antraquine compound, an azo metal complex, an allyl imide compound, or a mixture thereof. Also, "C.I. Pigment Yellow" 12, 13, 14, 17, 62, 74, 83, 93, 94, 95, 109, 110, 111, 128, 129, 147, 168, or 180 may be more particular examples of the yellow colorant.

The magenta colorant may be, for example, a condensed nitrogen compound, an antraquine compound, a quinacridone compound, a base dye late compound, a naphthol compound, a benzo imidazole compound, a thioindigo compound, and a pherylene compound, or a mixture thereof. Also, "C.I. Pigment Red" 2, 3, 5, 6, 7, 23, 48:2, 48:3, 48:4, 57:1, 81:1, 122, 144, 146, 166, 169, 177, 184, 185, 202, 206, 220, 221, or 254 may be more particular examples of the magenta colorant.

The cyan colorant may be, for example, a copper phthalocyanine compound and a derivative thereof, and an antraquine compound, a base dye late compound, or a mixture thereof. Also, "C.I. Pigment Blue" 1, 7, 15, 15:1, 15:2, 15:3, 15:4, 60, 62, or 66 may be more particular examples of the cyan colorant.

An amount of the colorant contained in the core particles may be in a range of, for example, about 0.1 parts to about 20 parts by weight, or about 2 parts to about 10 parts by weight based on 100 parts by weight of the binder resin.

The releasing agent may be, for example, a polyethylene-based wax, a polypropylene-based wax, a silicon-based wax, a paraffin-based wax, an ester-based wax, a carnauba-based wax, a metallocene-based wax, or a mixture thereof.

The releasing agent may have a melting point in a range of, for example, about 50° C. to about 150° C.

An amount of the releasing agent in the core particles may be in a range of, for example, from about 1 part to about 20 parts by weight or from about 1 part to about 10 parts by weight based on 100 parts by weight of the binder resin.

The core particles may be manufactured by using, for example, a pulverization method, an aggregation method, or a spray method. The pulverization method may be performed by, for example, pulverizing after melting and mixing a binder resin, a colorant, and a releasing agent. The aggregation method may be performed by, for example, aggregating particles after mixing a binder resin dispersion, a colorant dispersion, and a releasing agent dispersion, and by combining the resulting aggregation.

A volume average particle size of the core particles may in the range of, for example, about 4 μm to about 20 μm or about 5 μm to about 10 μm.

As a shape of the core particles is closer to a sphere, charge stability of the toner and dot reproducibility of the print image may be more improved, but a shape of the core particle is not limited thereto. The core particles may have a sphericity in a range of, for example, about 0.90 to about 0.99.

The toner according to the current embodiment of the present general inventive concept may be manufactured by attaching external additive particles on surfaces of the core particles. The attachment may be performed using, for example, a powder mixing apparatus. Particularly, for example, a Henshell mixer, a V-shape mixer, a ball mill, or a nauta mixer may be used as a powder mixing apparatus.

According to another embodiment of the present general inventive concept, a toner may have a degree of hydrophobicity from about 30 to about 60. If the degree of hydrophobicity is too small, moisture is attached to the toner in a high-humidity environment, and thus a quantity of charge of the toner decreases. Accordingly, an amount of the toner consumption increases, and supplying ability of the toner may be problematic since fluidity of the toner is decreased due to the moisture. On the other hand, if the degree of hydrophobicity is too large, filming on a surface of an OPC may be caused due to an excessive amount of a surface treating agent. The degree of hydrophobicity may be controlled by a type and an amount of an external additive.

The degree of hydrophobicity refers to a value measured by using a methanol titration method known in the art. For example, the degree of hydrophobicity may be measured as follows. To a glass beaker with an internal diameter of 7 cm, a capacity of 2 l or more, and containing 100 ml of ion exchange water is added 0.2 g of toner particles for measuring the degree of hydrophobicity, and is stirred with a magnetic stirrer. A tip part of a burette containing methanol is immersed in the suspension, into which 20 ml of methanol is dripped while being stirred, the stirring is stopped after 30 seconds, and 1 minute after stopping the stirring the state of the suspension is observed. This operation is repeatedly performed. When the silica particles do not float on the water surface 1 minute after stopping the stirring, the total added amount of methanol is taken as Y (ml) and a value obtained by the following formula is calculated as the degree of hydrophobicity. The water temperature in the beaker is adjusted to about 20° C.±1° C. to perform the measurement. The degree of hydrophobicity=[Y/(100+Y)×100].

According to another embodiment of the present general inventive concept, a dielectric loss factor of a toner may be from about 0.01 to about 0.03. If the dielectric loss factor of a toner is too small, a quantity of charge of the toner in a low-humidity environment rapidly increases, and thus charge-up may have occurred, and an image density may be decreased. However, if the dielectric loss factor of a toner is too large, the toner may not be charged enough, and thus a quantity of charge may be very low, or charge may be widely distributed. The dielectric loss factor of the toner may be closely related to a type and an added amount of titanium oxide.

In order to measure a dielectric loss factor of a toner, 8 g of a toner sample was first prepared, and the toner sample was pressed by a presser in a metal mold for a disk of 50 mm in diameter. A final thickness of the pressed toner is about 3.9 mm. The prepared toner sample was analyzed using a precision component analyzer (model: 6440B) manufactured by Wayne Kerr with a voltage of 5.00 Vac and a frequency of 2.0000 KHz. Then, the dielectric loss factor of the toner sample was calculated using the following Equations 1 and 2.

$$\in'=(t\times C)/(\pi\times(d/2)2\times\in_o) \quad \text{Equation 1}$$

$$\tan\theta=\in''/\in' \quad \text{Equation 2}$$

Here, $\in''$ is a dielectric loss factor, C is an electric capacity, tan θ is a loss tangent, and $\in'$ is a dielectric constant.

According to another embodiment of the present general inventive concept, silica particles in a toner may include a sol-gel silica with a number average aspect ratio from about 0.83 to about 0.97. Here, an aspect ratio refers to a ratio of a minimum diameter to a maximum diameter of sol-gel silica particles. A number average aspect ratio of the sol-gel silica particles in the current embodiment of the general inventive concept may be measured as follows. First, a plane image of toner particles that are externally added with the sol-gel particles that is 50,000 times magnified using a scanning electron microscopy (SEM) is obtained. Next, an aspect ratio of each of the sol-gel silica particles is obtained by measuring a minimum diameter and a maximum diameter of each of the sol-gel silica particles shown in the plane image with an image analyzer. Then, the sum of the aspect ratios of the sol-gel silica particles is divided by a number of the sol-gel silica particles to define a value of the number average aspect ratio of the sol-gel silica particles. Here, the number of the sol-gel silica particles included in the calculation of the number average aspect ratio is fixed to be 50. According to the current embodiment of the present general inventive concept, cleaning ability of a toner significantly increased when sol-gel particles having a number average aspect ratio in a range of about 0.83 to about 0.64 was used as an external additive. An increase in cleaning ability of a toner indicates that adhesion between toner particles and a surface of an OPC is appropriately decreased. If cleaning ability of a toner is increased during electrophotographic processes, untransferred toner remaining on the OPC after transferring may be removed almost completely by a cleaning blade. Accordingly, contamination of a charge roller due to untransferred toner may be suppressed. Also, a filming phenomenon on a surface of an OPC due to an untransferred toner may be suppressed. Also, if an external additive remains untransferred on the OPC, the external additive may pass through a niche between the cleaning blade and the OPC as the external additive is nano-sized. In particular, if particles of the external additive are spherical, rotation of the particles may be easy, and thus the particles may pass the cleaning blade easily. The external additive which passed the cleaning blade may contaminate the charge roller. Therefore, when an aspect ratio of silica is reduced to make it difficult for the particles of the external additive to pass the cleaning blade, cleaning ability of the external additive also improves.

Sol-gel silica particles may be obtained by, for example, removing a solvent from a sol-gel suspension that is produced by hydrolyzing and condensing alkoxy silane in an organic solvent in which water is present.

Example

Preparation Example 1

Preparation of Core Particles (i) Preparation of a First Binder Resin Latex

A polymerizable monomer mixture (825 g of styrene and 175 g of n-butyl acrylate), 30 g of β-carboxyethylacrylate (Sipomer, available from Rhodia), 17 g of 1-dodecanethiol as a chain transfer agent (CTA), and 418 g of a 2 wt % aqueous solution of sodium dodecyl sulfate (available from Aldrich) as an emulsifier were loaded into a 3 L beaker, and the mixture was stirred to prepare a polymerizable monomer emulsion. Separately, 16 g of ammonium persulfate (APS) as an initiator and 696 g of 0.4 wt % aqueous solution of sodium dodecyl sulfate (available from Aldrich) as an emulsifier were loaded into a 3 L double-jacketed reactor heated to a temperature of 75° C., and the polymerizable monomer emulsion separately prepared as described above was slowly added thereto dropwise for 2 hours or longer while stirring. A first binder resin was prepared through 8 hours of polymerization at 75° C. A particle size of the first binder resin of the prepared first binder resin latex was measured using a light scattering type particle size analyzer (Microtrac available from Honeywell) of a light scattering method, and the particle size was from about 180 nm to about 250 nm. A solid content of the latex measured by using a loss-on-drying method was about 42 wt %. A weight average molecular weight Mw of the latex measured using a gel permeation chromatography (GPC) method on a tetrahydrofuran (THF) soluble fraction was about 25,000 g/mol. A glass transition temperature of the latex measured by using a differential scanning calorimeter (DSC2000 available from TA) in a second heating curve at a heating rate of 10° C./min was about 62° C.

(ii) Preparation of a Second Binder Resin Latex

A polymerizable monomer mixture (685 g of styrene and 315 g of n-butyl acrylate), 30 g of β-carboxyethylacrylate (Sipomer, available from Rhodia), and 418 g of a 2 wt % aqueous solution of sodium dodecyl sulfate (available from Aldrich) as an emulsifier were loaded into a 3 L beaker, and the mixture was stirred to prepare a polymerizable monomer emulsion. Separately, 5 g of ammonium persulfate (APS) as an initiator and 696 g of 0.4 wt % aqueous solution of sodium dodecyl sulfate (available from Aldrich) as an emulsifier were loaded into a 3 L double-jacketed reactor heated to a temperature of 60° C., and the polymerizable monomer emulsion separately prepared as described above was slowly added thereto dropwise for 3 hours while stirring. A second binder resin was prepared through 8 hours of polymerization at 75° C. A particle size of the second binder resin latex was measured using a light scattering type particle size analyzer (LA-910 available from Horiba) of a light scattering method, and the particle size was from about 180 nm to about 250 nm. A solid content of the latex measured by using a loss-on-drying method was about 42 wt %. A weight average molecular weight Mw of the latex measured using a GPC method on a THF soluble fraction was about 250,000 g/mol. A glass transition temperature of the latex measured by using a differential scanning calorimeter (DSC2000 available from TA) in a second heating curve at a heating rate of 10° C./min was about 53° C.

(iii) Preparation of Colorant Dispersion 10 g of sodium dodecyl sulfate (available from Aldrich) as an anionic reactive emulsifier was loaded into a milling bath together with 60 g of carbon black pigment, and 400 g of glass beads having a diameter of about 0.8 mm to about 1 mm were added thereto and milling was performed thereon for 4 hours at room temperature to prepare a colorant dispersion. A pigment dispersion diameter was measured using a light scattering type particle size analyzer (Horiba 910), and the diameter was about 180 nm to about 200 nm. A solid content of the prepared colorant dispersion was about 18.5 wt %.

(iv) Preparation of Core Particles Using Aggregation Method 3,000 g of deionized water, 700 g of a binder resin latex mixture (95 parts by weight of the first binder resin latex and 5 parts by weight of the second binder resin latex), 195 g of the colorant dispersion, and 237 g of a wax dispersion (P-419 available from Chukyo Yushi Co., Ltd., about 30.5 wt % of solid content) were loaded into a 7 L reactor. 364 g of 0.3 M of nitric acid and 182 g of an aggregating agent (PSI-100 available from Suido Kiko Kaisha, Ltd.) were added to the mixture. Next, the mixture was stirred using a homogenizer at a rotational rate of 11,000 rpm for 6 minutes. Then, 417 g of the binder resin latex mixture was additionally added to the mixture, and the mixture was stirred for 6 more minutes to prepare a primary aggregation dispersion having a particle size distribution of about 1.5 μm to about 2.5 μm.

The temperature of the primary aggregation dispersion was increased from room temperature to 55° C. at a heating ratio of 0.5° C./min. When the particle size of the aggregation reached 6.0 μm, 442 g of the binder resin latex mixture (90 parts by weight of the first binder resin latex and 10 parts by weight of the second binder resin latex) was slowly added thereto for 20 minutes. When a volume average particle diameter of the aggregation reached about 6.8 μm, a 1 M NaOH aqueous solution was added thereto to control a pH to be 7. Then, the volume average particle diameter was maintained constant for 10 minutes, and the temperature of the aggregation dispersion was increased to 96° C. at a heating rate of 0.5° C./min. When the temperature reached 96° C., pH was adjusted to 6.0. Then, each of the coalesced particles was unified for 5 hours, thereby obtaining a secondary aggregation dispersion. Then, the aggregation was separated and dried from the secondary aggregation dispersion. The dried aggregatesare core particles. A volume average particle size of the core particles was 6.8, and a spericity of the core particles was 0.975.

Preparation Example 2

Preparation of Sol-Gel Silica Particles

A sol-gel silica (SG50 available from Sukgyung, Korea) having a single particle size of 70 nm, an apparent density of 220 g/L, and a number average aspect ratio of 0.90 was hydrophobic-treated with a dimethyldiethoxysilane (DMDES) solution with a concentration of 30 wt %. A loaded amount of the DMDES was 5 wt % of the dry weight of the silica.

Example 1

Preparation of Toner 100 parts by weight of the core particles, 1.0 part by weight of the sol-gel silica of Preparation Example 2, 1.0 part by weight of fumed silica (RX200 available from Evonik, Japan), which has a primary diameter of 10 nm, an apparent density of 140 g/L, a surface treated with hexamethyldisilazane (HMDS), and an entrained quantity of charge that is about 0 to about −400 uC/g when measured using ferrite, and 0.5 parts by weight of rutile-type titanium dioxide (KT501 available from Eiwa, Japan) hydrophobically-treated with polydimethylsilane (PDMS) were put into an external adder (KMLS2K available from Dae Wha Tech IND., Korea), followed by mixing at 2000 rpm for 30 seconds and stirring at 6000 rpm for another 3 minutes to add an external additive onto surfaces of the core particles of Preparation Example 1. A toner obtained as a result had a volume average particle of 6.8 μm, and values of GSDp and GSDv were 1.282 and 1.217, respectively. Also, an average sphericity of the toner was 0.975.

Examples 2 to 7

Preparation of Toners

Toners were prepared in the same manner as in Example 1, except that used amounts of the sol-gel silica, fumed silica, and titanium dioxide were varied.

Comparative Examples 1 to 6

Preparation of Toners

Toners were prepared in the same manner as in Example 1, except that used amounts of the sol-gel silica, fumed silica, and titanium dioxide were varied.

Compositions of the toners prepared in Examples 1 to 7 and Comparative Examples 1 to 6 are summarized in Table 1.

TABLE 1

| Category | Parts by weight of each external additive used based on 100 parts by weight of core particles | | |
|---|---|---|---|
| | Sol-gel silica (70 nm) | Fumed silica (12 nm) | Titanium dioxide (50 nm) |
| Example 1 | 1.0 | 1.0 | 0.5 |
| Example 2 | 1.0 | 1.0 | 1.0 |
| Example 3 | 1.0 | 1.0 | 1.5 |
| Example 4 | 0.5 | 1.0 | 1.0 |
| Example 5 | 1.5 | 1.0 | 1.0 |
| Example 6 | 1.0 | 0.5 | 1.0 |
| Example 7 | 1.0 | 1.5 | 1.0 |
| Comparative Example 1 | 1.0 | 1.0 | 0.1 |
| Comparative Example 2 | 1.0 | 1.0 | 2.0 |
| Comparative Example 3 | 0.1 | 1.0 | 1.0 |
| Comparative Example 4 | 2.0 | 1.0 | 1.0 |
| Comparative Example 5 | 1.0 | 0.1 | 1.5 |
| Comparative Example 6 | 1.0 | 2.0 | 1.5 |

<Evaluation Method>

In order to evaluate the characteristics of the toners prepared in Examples 1 to 7 and Comparative Examples 1 to 6, tests were performed in the following manner. First, the cohesiveness was measured for evaluation of the fluidity of the obtained toners. A non-contact type non-magnetic monocomponent development printer (CLP-680 available from Samsung Electronics Co., Ltd) was used to print up to 6,000 sheets at 1% coverage and thus measuring the developability, transferability, image concentration, image contamination, and variations over time (variations in toner layers and image concentration on a developing roller according to the number of sheets printed).

Cohesiveness (Toner fluidity)

Equipment: Hosokawa micron powder tester PT-S

Amount of sample: 2 g

Amplitude: 1 mm dial 3~3.5

Sieve: 53, 45, 38 μm

Vibration time: 120±0.1 seconds.

After the samples were stored at room temperature (20° C.) and RH of 55±5% for 2 hours, the samples were sieved under the above conditions to calculate the cohesiveness of toner as follows.

[(mass of powders remaining on 53 μm sieve)/2 g]×100 1)

[(mass of powders remaining on 45 μm sieve)/2 g]×100×(3/5) 2)

[(mass of powders remaining on 38 μm sieve)/2 g]×100×(1/5) 3)

Degree of cohesiveness (Carr's cohesion)=(1)+(2)+(3)

Standard of Cohesiveness Evaluation

◎: Vastly superior fluidity, having a degree of cohesiveness of 10 or less

○: Satisfactory fluidity, having a degree of cohesiveness of more than 10 to 15 or less Δ: Inferior fluidity, having a degree of cohesiveness of more than 15 to 20 or less x: Vastly inferior fluidity, having a degree of cohesiveness of more than 20

Developability

An image of a predetermined area was allowed to be developed on an OPC before toners were transferred from the OPC to an intermediate transfer member, and then the weight of toner per unit area of the OPC was measured by using a suction apparatus to which a filter is attached. The weight of toner per unit area on a developing roller was simultaneously measured to evaluate the developability as follows.

Development efficiency=Weight of toner per unit area of electrophotographic photoreceptor/Weight of toner per unit area of developing roller.

Standard of Developability Evaluation

◎: Development efficiency of 90% or more

○: Development efficiency of 80% or more

Δ: Development efficiency of 70% or more x: Development efficiency of 60% or more Transferability (Primary and Secondary)

Through evaluation of the developability, a primary transferability was evaluated by using a ratio of a weight of toner per unit area of the OPC and a weight of toner per unit area of an intermediate transfer member after the toner was transferred from the OPC to the intermediate transfer body. In addition, a secondary transferability was evaluated by using a ratio of a weight of toner per unit area of the intermediate transfer member and a weight of toner per unit area on paper after the toner was transferred to the paper. The transferability was evaluated by using an unfixed image which had not been fixed to measure a weight of toner per unit area on the paper.

Primary transfer efficiency=Weight of toner per unit area on intermediate transfer member/Weight of toner per unit area of OPC Secondary transfer efficiency=Weight of toner per unit area on paper/Weight of toner per unit area of intermediate transfer member Transfer efficiency=Primary transfer efficiency·Secondary transfer efficiency.

Standard of Transferability Evaluation

◎: Transfer efficiency of 90% or more

○: Transfer efficiency of 80% or more

Δ: Transfer efficiency of 70% or more x: Transfer efficiency of 60% or more

OPC Background Contamination

Optical densities were measured at three points by taping a non-image region on a drum of the OPC after printing 10 pages, and then an average was confirmed. The image concentration was measured using a reflection densitometer available from Electroeye. The measurement results were classified according to the following standard.

◎: Optical density of less than 0.03

○: Optical density of 0.03 or more to less than 0.05

Δ: Optical density of 0.05 or more to less than 0.07 x: Optical density of 0.07 or more

Image Contamination (Charge-Up)

Degrees of the image contamination caused by charge-up according to a prolonged image output were measured along with the following standard.

◎: No image contamination

○: Slight image contamination

Δ: High image contamination x: Very high image contamination

Life Durability (Variations Over Time)

When 5,000 sheets were printed, a weight of toner per unit area on a developing roller was measured to evaluate a degree of variation relative to the initial phase as the number of sheets to be printed increased.

The measurement results were classified according to the following standard.

◎: A weight of toner per unit area of a developing roller after printing 5,000 sheets was increased less than 10% relative to that of the initial phase ○: A weight of toner per unit area of a developing roller at 5,000 sheets was increased 10% or more to less than 20% relative to that of the initial phase Δ: A weight of toner per unit area of a developing roller at 5,000 sheets was increased 20% or more to less than 30% relative to that of the initial phase x: A weight of toner per unit area of a developing roller at 5,000 sheets was increased 30% or more relative to that of the initial phase.

The results of performance evaluation of the toners prepared in Examples 1 to 7 and Comparative Examples 1 to 6 are summarized in Table 2 below.

TABLE 2

| Category | XRF data [Ti]/[Fe] | XRF data [Si]/[Fe] | Image contamination (charge-up) | Developability/ transferability | OPC contamination | Life durability (variations over time) |
|---|---|---|---|---|---|---|
| Example 1 | 0.8 | 0.007 | ○ | ○ | ◎ | ○ |
| Example 2 | 1.4 | 0.007 | ◎ | ◎ | ◎ | ◎ |
| Example 3 | 2.0 | 0.007 | ○ | | ○ | ○ |
| Example 4 | 1.4 | 0.004 | ○ | ○ | ◎ | ○ |
| Example 5 | 1.4 | 0.009 | ○ | ◎ | ○ | ○ |
| Example 6 | 1.4 | 0.004 | ◎ | ○ | ○ | ○ |
| Example 7 | 1.4 | 0.009 | ○ | ○ | ○ | |
| Comparative Example 1 | 0.15 | 0.007 | x | ◎ | ○ | ◎ |
| Comparative Example 2 | 2.8 | 0.007 | ○ | ○ | x | ○ |
| Comparative Example 3 | 1.4 | 0.0035 | ○ | x | ◎ | x |
| Comparative Example 4 | 1.4 | 0.01 | ◎ | ○ | x | ◎ |
| Comparative Example 5 | 1.4 | 0.0035 | ○ | ◎ | ◎ | x |
| Comparative Example 6 | 1.4 | 0.01 | x | x | ◎ | ◎ |

As shown in Table 2, the toners in Examples 1 to 7 which satisfied both conditions of 0.004≤[Si]/[Fe]≤0.009 and 0.8≤[Ti]/[Fe]≤2 had significantly improved characteristics in all categories such as image contamination, developability/transferability, OPD contamination, and durability. However, the toners in Comparative Examples 1 and 2, which did not satisfy the condition of 0.8≤[Ti]/[Fe]≤2, and the toners in Comparative Examples 3 to 6, which did not satisfy the condition of 0.004≤[Si]/[Fe]≤0.009, failed to simultaneously satisfy all categories such as image contamination, developability/transferability, OPD contamination, and durability.

According to one or more embodiments of the present general inventive concept, charge uniformity, charge stability, transferability, and cleaning ability of a toner may be all simultaneously improved when an iron intensity [Fe], a silicon intensity [Si], and a titanium intensity [Ti] that are measured by X-ray fluorescence satisfy all the conditions above.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A toner to develop electrostatic latent images, the toner comprising:

core particles comprising a binder resin, a colorant, and a releasing agent; and an external additive comprising silica particles and titanium dioxide particles, wherein the external additive is attached to external surfaces of the core particles, wherein an iron intensity [Fe], a silicon intensity [Si], and a titanium intensity [Ti] that are measured by X-ray fluorescence (XRF) satisfy both conditions, 0.004≤[Si]/[Fe]≤0.009 and 0.8≤[Ti]/[Fe]≤2.

2. The toner of claim 1, wherein the silicon intensity [Si], and the titanium intensity [Ti] that are measured by XRF satisfy a condition, 0.002≤[Si]/[Ti]≤0.1.

3. The toner of claim 1, wherein a degree of hydrophobicity of the toner is in a range of about 30 to about 60.

4. The toner of claim 1, wherein a dielectric loss factor of the toner is in a range of about 0.01 to about 0.03.

5. The toner of claim 1, wherein the silica particles comprise sol-gel silica that has a number average aspect ratio in a range of about 0.83 to about 0.97.

6. The toner of claim 1, wherein the silica particles have a large diameter of a volume average particle size in a range of about 30 nm to about 100 nm and silica particles with a small diameter of a volume average particle size in a range of about 5 nm to about 20 nm.

7. The toner of claim 6, wherein a weight ratio of the silica particles with a large diameter to the silica particles with a small diameter is from about 0.5:1.5 to about 1.5:0.5.

* * * * *